United States Patent [19]

Vince

[11] Patent Number: 4,569,141

[45] Date of Patent: Feb. 11, 1986

[54] HEEL MEMBER

[76] Inventor: Albert E. Vince, 6, Alderman Willey Close, Wokingham, Berkshire, England

[21] Appl. No.: 542,496

[22] Filed: Oct. 17, 1983

[51] Int. Cl.[4] ..... A43B 21/24

[52] U.S. Cl. ..... 36/35 R; 36/36 R; 36/42

[58] Field of Search ..... 36/35 R, 36 R, 42, 35 A

[56] References Cited

U.S. PATENT DOCUMENTS

| | | | |
|---|---|---|---|
| 2,048,683 | 7/1936 | Brockman | 56/35 R |
| 3,822,490 | 7/1974 | Murawski | 36/35 R |
| 4,417,408 | 11/1983 | Metro | 36/36 R |

FOREIGN PATENT DOCUMENTS

| | | | |
|---|---|---|---|
| 1903717 | 8/1970 | Fed. Rep. of Germany | 36/36 R |
| 2764 | of 1903 | United Kingdom | 36/35 R |
| 10773 | of 1915 | United Kingdom | 36/35 R |

*Primary Examiner*—Henry S. Jaudon
*Assistant Examiner*—Mary A. Ellis
*Attorney, Agent, or Firm*—Pretty, Schroeder, Brueggemann & Clark

[57] ABSTRACT

A heel member (10) for attachment to a heel stub has a ground engaging surface that matches in size and shape the heel stub surface to which it is to be attached and has a stub engaging surface 10*b* which is cut away (10*c*) in the rear curved region (10*d*) of the heel member so that, when attached, an open but confined space 14 is provided between the stub and a rear peripheral part of the heel member to allow flexing of said unsupported rear part. A plurality of peripherally spaced webs (10*e*) may be provided in the cut away region (10*d*) to support, and assist the return action of the rear part of the heel member during flexing.

6 Claims, 3 Drawing Figures

HEEL MEMBER

The present invention relates to footwear and in particular to the heel structure of such footwear.

A conventional heel structure comprises a heel stub to which is secured as by gluing or nailing, a ground engaging heel member having an upper stub-facing, surface of size and shape matching that of the lower face of the stub.

The disadvantages with the above described conventional heel structure are (1) the rear curved edge of the heel member is worn away in a very short time due to constant contact of the heel structure in use with hard surfaces and (2) the heel structure is not designed to effectively absorb the shock transmitted to the feet and legs of the users when walking on hard surfaces.

It is an aim of the present invention to provide a heel member and heel structure that will make footwear more comfortable to wear by absorbing more shock and that will make the heel member more durable.

According to the present invention, there is provided a heel member of resilient material for attachment to a footwear heel stub, the member having a ground engaging surface that matches in size and shape the heel stub surface to which it is to be attached and having a stub engaging surface opposite the ground engaging surface which is cut away in the rear curved region of the heel member so that when the heel member is attached to the heel stub an open but confined space is provided between the stub and a rear peripheral part of the heel member to allow flexing of said unsupported rear part, the heel member being such that pressure applied to the rear of the heel member during walking causes the rear part to flex toward and into contact with the heel stub thereby at least partly closing the confined space.

Figure 1:
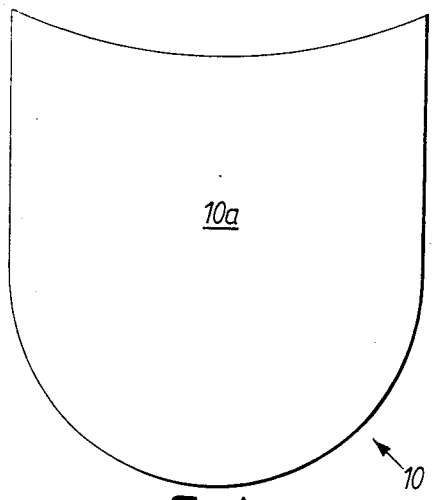
Figure 2:
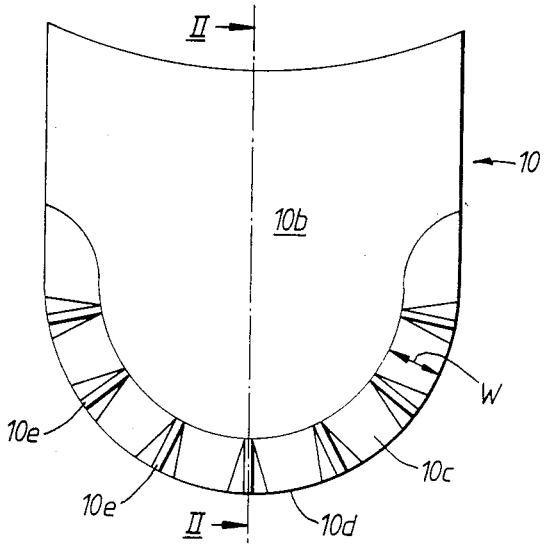
Figure 3:
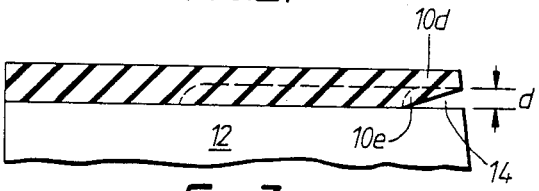

An embodiment of the invention will now be described by way of example, with reference to the accompanying drawings, in which:

FIG. 1 is an under plan view of a footwear heel member according to the present invention, FIG. 2 is a plan view of the heel member of FIG. 1, and FIG. 3 is a section through the heel member taken on the line II—II of FIG. 2 but with the heel member secured to the inverted heel stub (shown only partially) of a boot or shoe.

Referring to the drawings, the heel member 10 is of a resilient material such as a good quality natural rubber or a plastics material of similar properties. The member 10 has a ground engaging surface 10*a* that matches in size and shape the heel stub 12 to which the heel member is to be attached, and a stub engaging surface 10*b* opposite surface 10*a* which is stepped or cut away in the rear curved region 10*d* the heel member to provide an arcuate land 10*c*. The arcuate land 10*c* extends at least partly around the curved periphery of the heel, preferably the entire curved periphery as shown in FIG. 2. As shown, the width w of the land is a about 11% of the total width of the heel member and the depth d of the land, that is its distance from the surface 10*b*, is about 50% of the thickness of the heel member; these figures may be varied as required.

When the heel member 10 is attached to the stub 12, it will be apparent (see FIG. 3) that the rear curved portion 10*d* of the heel member defines an open but confined arcuate space or channel 14 with stub 12. Thus when pressure is applied to the rear edge of the heel during walking, the rear portion 10*d* is bent in cantilever fashion toward and into contact with the heel stub, to close the space or channel. Upon further compression, the rear portion acts as though it were integral with the heel stub. On removal of the pressure the rear portion 10*d* returns to its initial relaxed condition.

To assist the return function and also to provide strengthening for rear portion 10*d*, the heel is provided with a plurality of integral peripherally spaced wedge-shaped ribs 10*e* of the same material as the heel member 10. The ribs 10*e* are spaced around the land 10*c* (see FIG. 2). The upper surface of each rib 10*e* slopes from the level of the surface 10*b* downwardly to the level of the land 10*c* to meet the land 10*c* at its outer periphery (see FIG. 3). In operation, the ribs 10*e* are compressed by engagement with stub 12 prior to the compression of portion 10*d*.

It will be appreciated that the cantilever action of the rear portion 10*d* of the heel member will help to reduce and cushion shock forces experienced by the user during walking on hard surfaces, and also that the cushioning action will prolong the wearing period of the heel member.

In a modification, the heel member prior to attachment to the heel stub, may be of a two part construction. In this construction, the lower part would be shaped like a conventional heel member and the upper part would be shaped to include the land 10*c*, and the ribs 10*e*.

In a further modification, the surface of the heel member to be attached to the heel stub may include hollow recesses or cells to reduce the overall weight of the heel member and to increase its flexibility.

Preferably the area of the land 10*c* should be in the range 10–20% of the total plan area of the heel, and the thickness of the rear portion 10*d* should be in the range 40 to 60% of the total thickness of the heel member. Conveniently, the land 10*c* may be located on one side only of the heel member.

In use, dirt and small stones are effectively prevented from entering confined space 14, by the constant movement of rear portion 10*d* which repeatedly closes and opens the space during the walking operation.

It will be apparent that the cantilever action of the above described heel member ensures that during walking, the rear portion 10*d* flexes (whilst the footwear is in contact with the ground at an angle of impact of say 15–30 degrees) and then is stopped firmly by its contact with the stub 12, thereby giving complete stability regardless of body weight. By absorbing the shock as a result of flexure of the rear portion, the standard of walking comfort is greatly improved with resulting medical benefits.

I claim:

1. In footwear having a heel stub, a heel member of resilient material for attachment to the heel stub, the member comprising a ground engaging surface that matches in size and shape the heel stub surface to which it is to be attached, a stub engaging surface opposite the ground engaging surface, and a rear curved region which is cut away to define an open but confined arcuate channel between the ground engaging surface and the stub to provide an unsupported arcuate rear part, and a plurality of peripherally-spaced ribs located in the channel, wherein the unsupported rear part is so profiled that pressure applied to any portion of the unsupported rear part during walking causes at least the ribs at that portion to flex toward and into contact with the overlying heel stub to close the confined channel in the region of the pressure, such that, while so closed, the heel member reacts to pressures as though it were integral with the heel stub.

2. The heel member of claim 1, wherein the thickness of said rear part is between 40 and 60% of the total thickness of the heel member.

3. The heel member of claim 2, wherein the thickness of said rear part is about 50% of the total thickness of the heel member.

4. The heel member of claim 1, wherein the overall area of the channel is in the range of 10–20% of the total plan area of the heel.

5. The heel member of claim 1, wherein the channel area extends substantially around the entire rear curved portion of the heel member.

6. A heel stub with a heel member according to claim 1 attached thereto.

* * * * *